US007303463B2

(12) United States Patent
Kubo

(10) Patent No.: US 7,303,463 B2
(45) Date of Patent: Dec. 4, 2007

(54) SEMICONDUCTOR WAFER POLISHING APPARATUS, AND METHOD OF POLISHING SEMICONDUCTOR WAFER

(75) Inventor: Akira Kubo, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 11/600,857

(22) Filed: Nov. 17, 2006

(65) Prior Publication Data

US 2007/0128990 A1 Jun. 7, 2007

(30) Foreign Application Priority Data

Dec. 5, 2005 (JP) ..... 2005-351240

(51) Int. Cl.
*B24B 1/00* (2006.01)

(52) U.S. Cl. ..... 451/44; 451/54; 451/246

(58) Field of Classification Search ..... 451/43, 451/44, 54, 242, 246, 285; 134/1.3, 902
See application file for complete search history.

(56) References Cited

U.S. PATENT DOCUMENTS 5,331,772 A * 7/1994 Steere et al. ..... 451/451
5,556,324 A * 9/1996 Shank, Jr. ..... 451/89
5,560,743 A * 10/1996 Imayama et al. ..... 451/2
6,062,950 A * 5/2000 Morgan ..... 451/28
6,623,339 B1 * 9/2003 Igarashi et al. ..... 451/42
6,773,334 B1 * 8/2004 Mallison ..... 451/38
6,933,234 B2 * 8/2005 Nakamura et al. ..... 438/690
7,073,495 B1 * 7/2006 Markley ..... 125/13.01
2003/0139049 A1 * 7/2003 Nakamura et al. ..... 438/692

FOREIGN PATENT DOCUMENTS

JP 62079964 A * 4/1987
JP 63250829 A * 10/1988
JP 2005-26274 1/2005

* cited by examiner

*Primary Examiner*—Eileen P. Morgan
(74) *Attorney, Agent, or Firm*—Young & Thompson

(57) ABSTRACT

Aimed at thoroughly preventing abrasive and dusts from adhering onto the circuit-forming region of a wafer, improving yield ratio of semiconductor devices, and thereby improving operation rates of the individual manufacturing apparatuses in the succeeding stage, a semiconductor wafer polishing apparatus of the present invention has a polishing unit polishing the circumferential edge side of a disc-formed wafer; and a gas blowing unit blowing a gas G against the surface of the wafer, so as to separate the space over the wafer by a curtain C of the gas G between a polishing field PF in which the wafer is polished by the polishing unit and a normal field NF except the polishing field PF.

11 Claims, 11 Drawing Sheets

SEMICONDUCTOR WAFER POLISHING APPARATUS, AND METHOD OF POLISHING SEMICONDUCTOR WAFER

This application is based on Japanese patent application No. 2005-351240, the content of which is incorporated hereinto by reference.

BACKGROUND

1. Technical Field

The present invention relates to a semiconductor wafer polishing apparatus polishing a circumferential edge side of a wafer, and a method of polishing a semiconductor wafer.

2. Related Art

With developing larger scale of integration of circuits, decreasing pattern size and enlarging wafer diameter in semiconductor manufacturing process, a higher chip yield has been desired. One known technique of improving the chip yield ever adopted is to remove an unnecessary portion of films formed on the bevel portion and notch portion of the circumferential edge of a wafer. The bevel portion of a wafer is slightly rounded when one views from the side, and the notch portion of a wafer is near V-shape when one views from the top surface. For this reason, the films easily peels off from the bevel portion and the notch portion of a wafer in diffusion process and those films may adhere onto the top and back surfaces of the wafer, to result in the yield loss and/or the apparatus down. Bevel polishing can prevent these problems.

As this kind of polishing apparatus, there has been known an apparatus configured as holding a wafer in a rotatable manner, and as allowing one surface of a polishing pad to freely contact with the bevel portion of the wafer (see Japanese Laid-Open Patent Publication No. 2005-26274, for example). FIG. 11 is a schematic drawing showing the conventional semiconductor wafer polishing apparatus. This polishing apparatus is configured so as to rotate the wafer while supplying an abrasive onto the surface, and to allow the polishing pad to contact with the bevel portion to thereby polish the bevel portion over the entire range of its circumference. The polishing apparatus also has a nozzle blowing a non-reactive gas against the surface of the wafer, aiming at spreading the gas emitted from the nozzle over the surface of the wafer making use of rotation of the wafer, to thereby prevent the abrasive from infiltrating into the central region as viewed in the radial direction.

However, in the polishing apparatus described in Japanese Laid-Open Patent Publication No. 2005-26274, configured as diffusing the gas over the surface of the wafer making use of rotation of the wafer, route and rate of flow of the gas vary due to changes in conditions such as rotation speed of the wafer, blowing speed of the gas and so forth. As a consequence, the gas cannot uniformly be diffused, thereby making it difficult to suppress infiltration of the abrasive by stably spreading the gas over the surface of the wafer. Blowing from the nozzle only at one point is also highly causative of charge generation on the surface of the wafer, which may degrade the device quality being fabricated on the semiconductor wafer.

SUMMARY OF THE INVENTION

According to the present invention, there is provided a semiconductor wafer polishing apparatus comprising a polishing unit polishing the circumferential edge side of a disc-formed wafer; and a gas blowing unit blowing a gas against the surface of the wafer, so as to separation the space over the wafer by a curtain of the gas between a polishing field in which the wafer is polished by the polishing unit and a normal field except the polishing field.

In this semiconductor wafer polishing apparatus, migration of substances between the polishing field and the normal field can be suppressed by forming a curtain of a blown gas. More specifically, by forming the curtain when the circumferential edge side of the wafer is polished by the polishing unit, the abrasive supplied to the polishing unit during polishing and dusts generated during polishing are prevented from infiltration into the normal field. Because the gas herein is blown so as to form the curtain, flow of the gas is relatively stabilized without being destabilized in the gas flow such as in the conventional apparatus based on the single point blowing of the gas.

According to the present invention, there is also provided a method of polishing a semiconductor wafer polishing the circumferential edge side of a disc-formed wafer, by blowing a gas against the surface of the wafer, so as to separate the space over the wafer by a curtain of the gas between a polishing field in which the wafer is polished by the polishing unit and a normal field except the polishing field.

As is clear from the above, according to the present invention, the abrasive and the dusts can thoroughly be prevented from adhering onto the circuit-forming region of the wafer, the chip yield of the wafer can be improved, and thereby the operation rates of the individual manufacturing apparatuses in the succeeding process step can be improved.

BRIEF DESCRIPTION OF THE DRAWINGS

The above and other objects, advantages and features of the present invention will be more apparent from the following description taken in conjunction with the accompanying drawings, in which.

DETAILED DESCRIPTION OF THE PREFERRED EMBODIMENT

Figure 1:
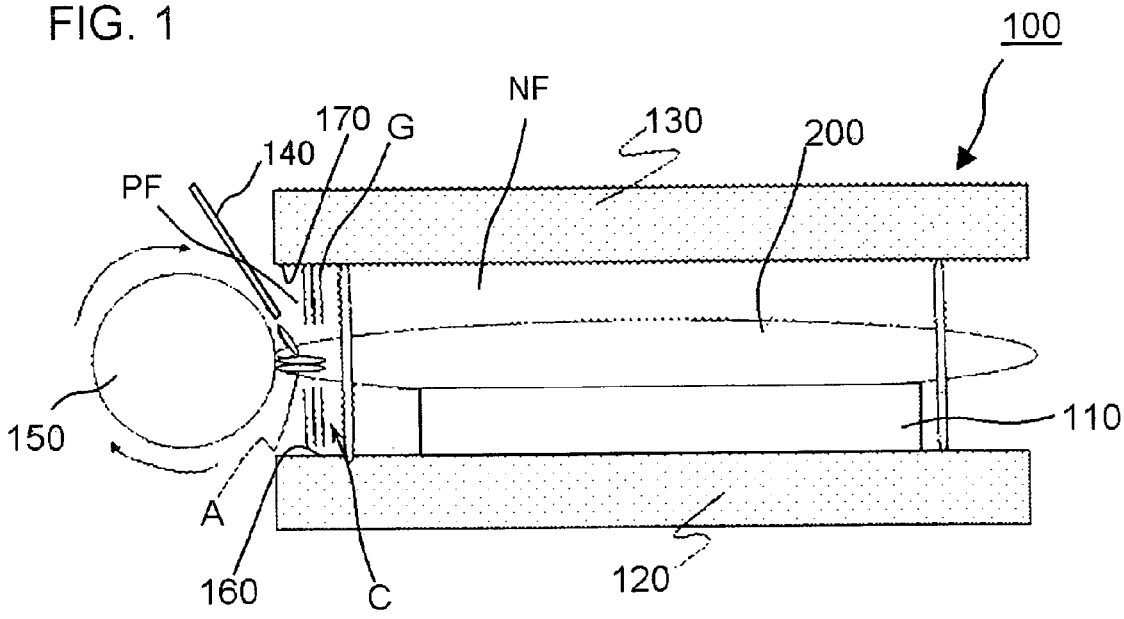
FIG. 1 shows a schematic drawing showing a semiconductor wafer polishing apparatus for polishing a notch portion according to a first embodiment of the present invention.

The invention will be now described herein with reference to illustrative embodiments. Those skilled in the art will recognize that many alternative embodiments can be accomplished using the teachings of the present invention and that the invention is not limited to the embodiment illustrated for explanatory purposed.

Paragraphs below will detail preferable embodiments of the semiconductor wafer polishing apparatus of the present invention, referring to the attached drawings. Any identical components will be given with the same reference numerals, in order to avoid repetitive explanation.

Figure 2:
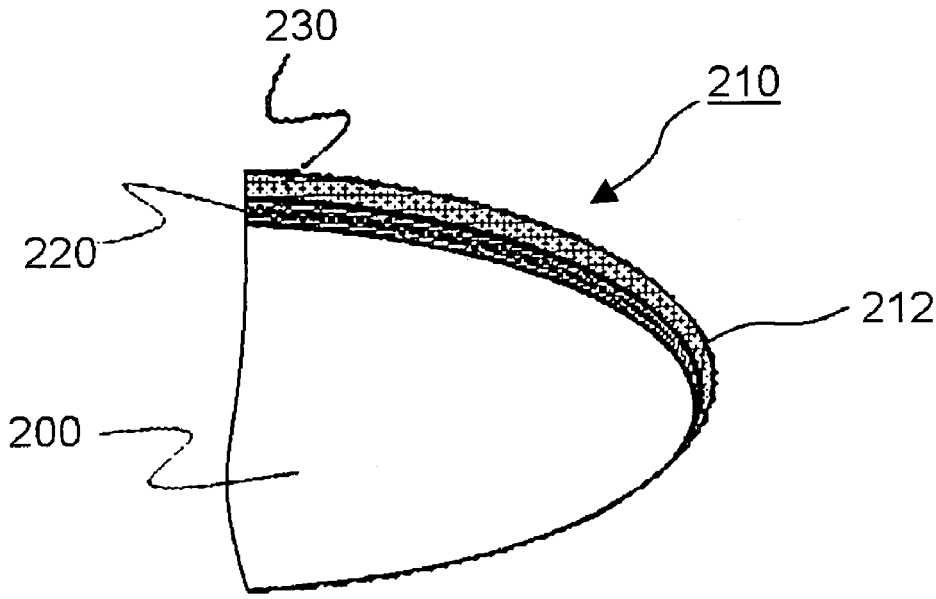
FIG. 2 shows a cross section drawing explaining the circumferential edge portion of the semiconductor wafer.
Figure 3:
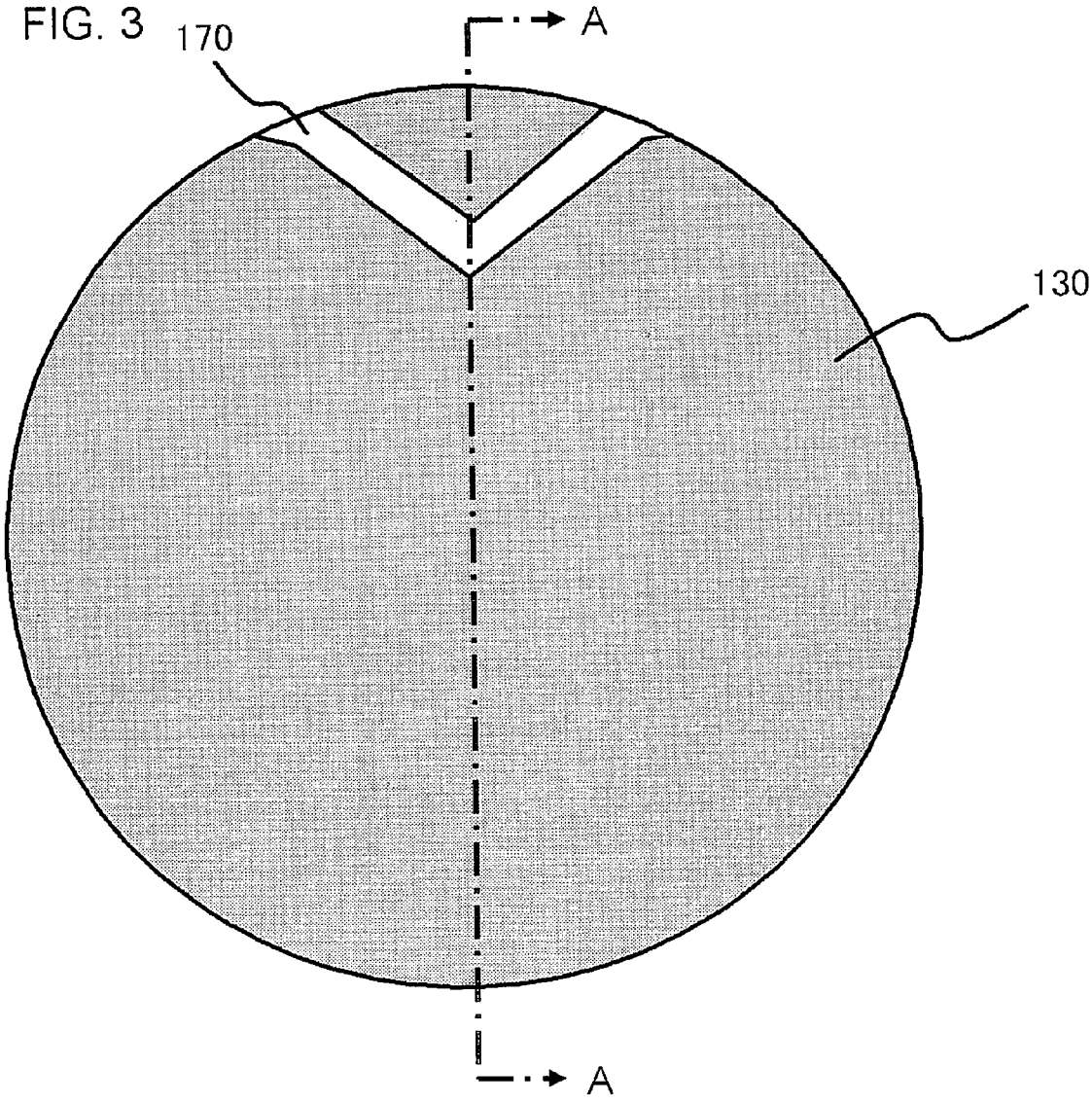
FIG. 3 shows a schematic bottom view of an upper supporting unit of the semiconductor wafer polishing apparatus polishing the notch portion.
Figure 4:
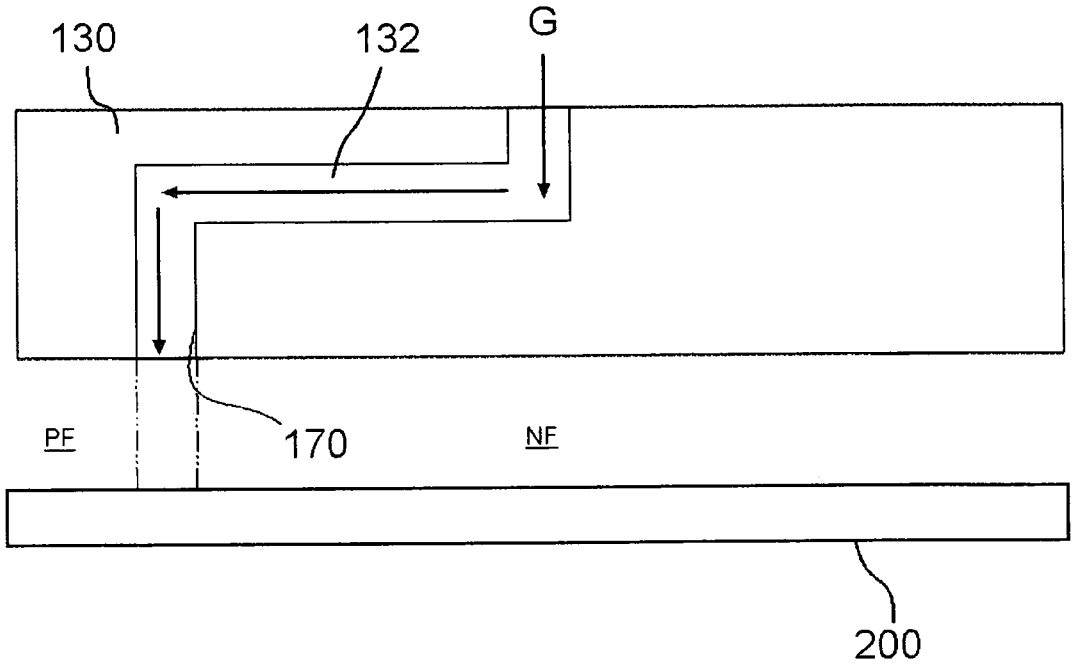
FIG. 4 shows a sectional view along a line A-A in FIG. 3.
Figure 5:
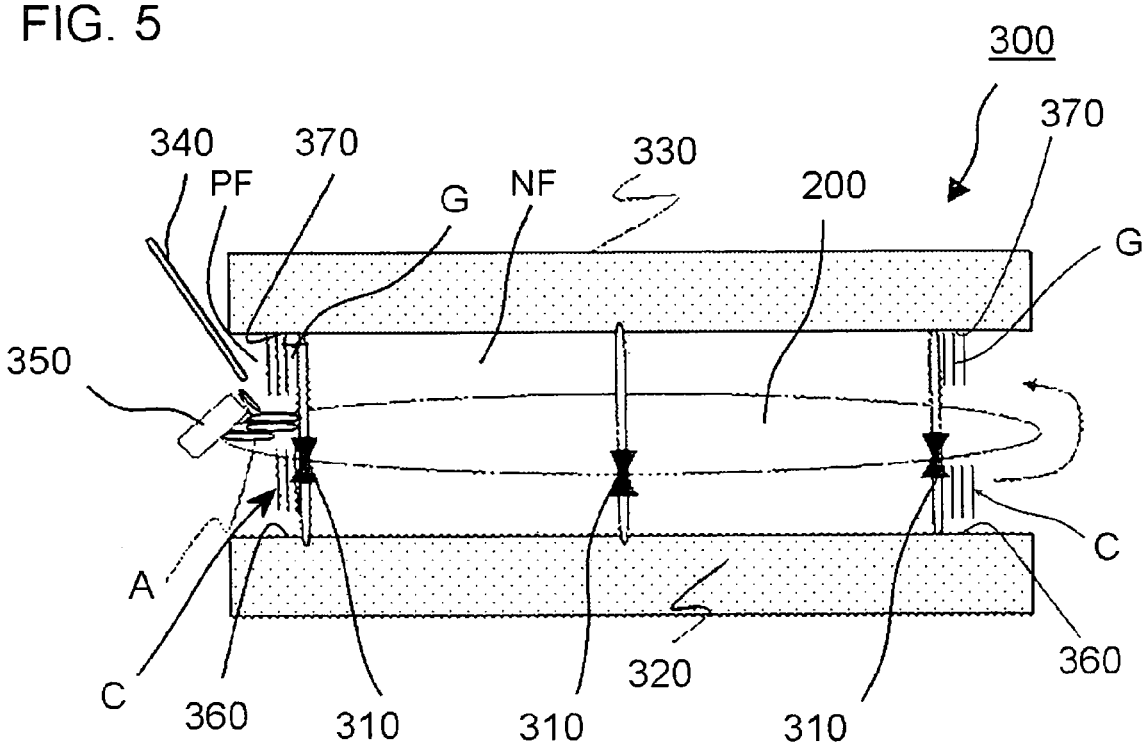
FIG. 5 shows a schematic drawing of a semiconductor wafer polishing apparatus polishing a bevel portion.
Figure 6:
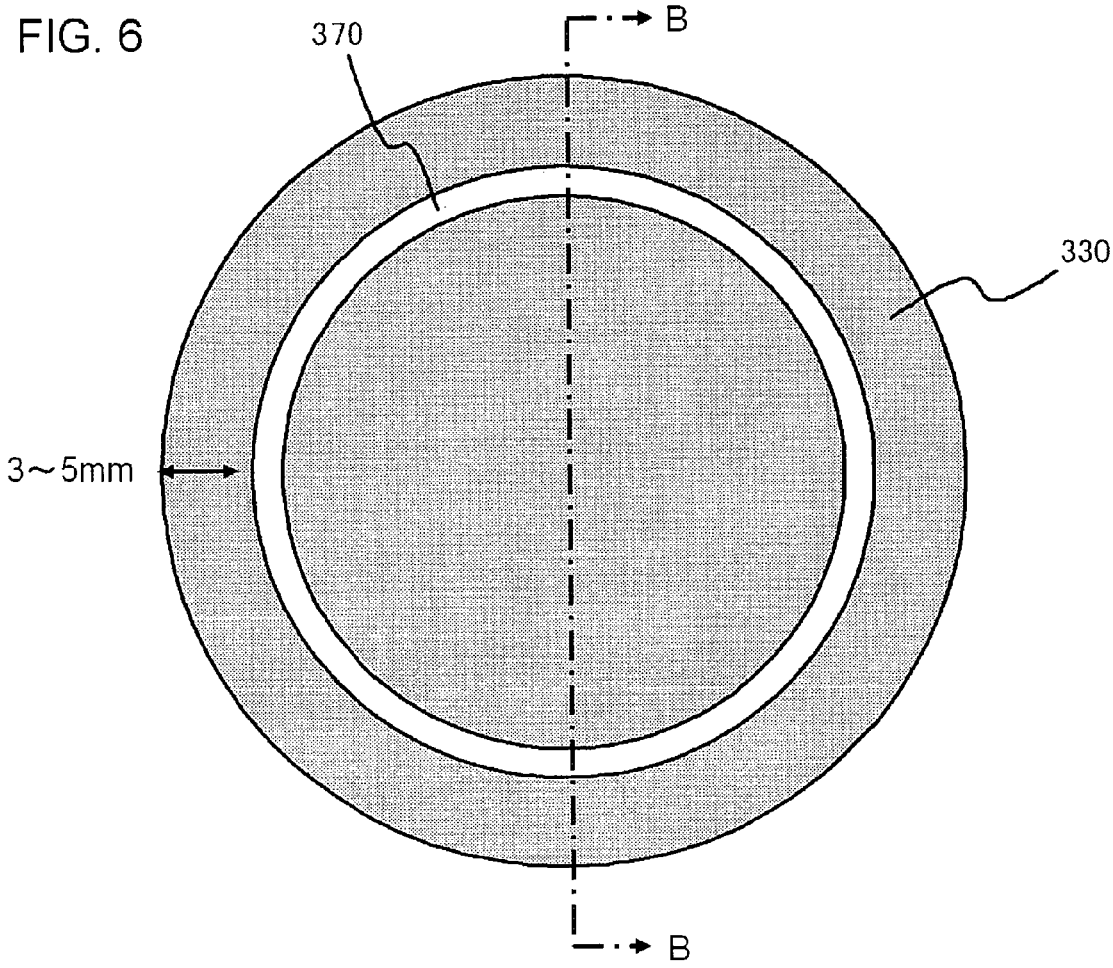
FIG. 6 shows a schematic bottom view of an upper supporting unit of the semiconductor wafer polishing apparatus polishing the bevel portion.
Figure 7:
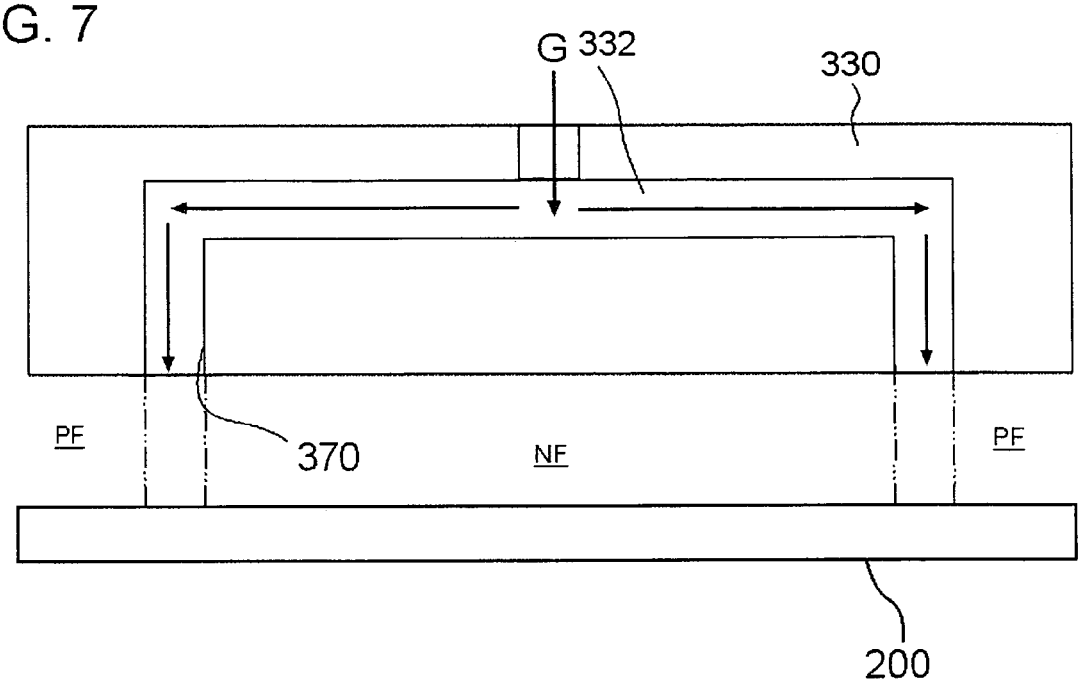
FIG. 7 shows a sectional view taken along line B-B in FIG. 6.
Figure 8:
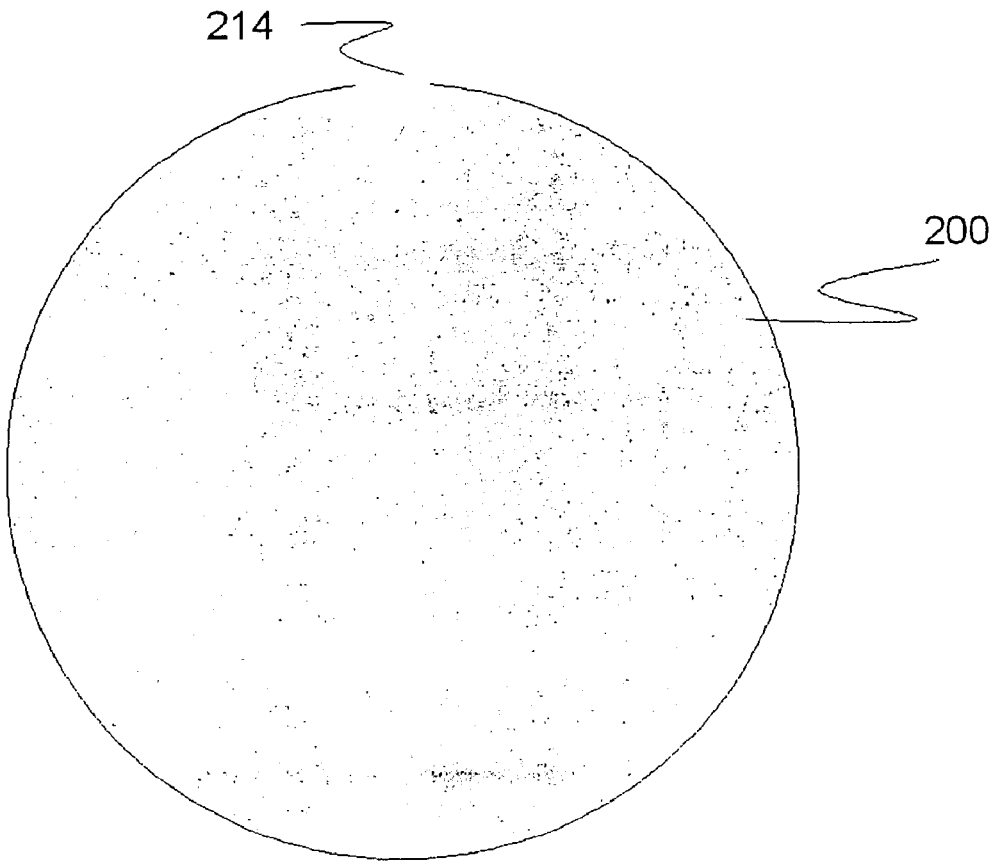
FIG. 8 shows a top view of a wafer.

FIG. 1 to FIG. 8 show a first embodiment of the present invention, wherein FIG. 1 is a schematic drawing showing a semiconductor wafer polishing apparatus for polishing a notch portion, FIG. 2 is a drawing explaining the circumferential edge portion of the semiconductor wafer, FIG. 3 is a schematic bottom view of an upper supporting unit of the semiconductor wafer for polishing apparatus polishing the notch portion, FIG. 4 is a sectional view taken along line A-A in FIG. 3, FIG. 5 is a schematic drawing of a semiconductor wafer polishing apparatus polishing a bevel portion, FIG. 6 is a schematic bottom view of an upper supporting unit of the semiconductor wafer for polishing apparatus polishing the bevel portion, FIG. 7 is a sectional view along a line B-B in FIG. 6, and FIG. 8 is a top view of a wafer. It is to be noted that the curtain, shown in FIG. 5 as being illustrated only on the left hand side and on the right hand side for the convenience of explanation, is actually formed so as to surround the inner portion of the wafer smaller as viewed in radial direction.

As shown in FIG. 1, a polishing apparatus 100 for a semiconductor wafer 200 has, as being provided in a chamber thereof, a wafer chucking mechanism 110 as a wafer holding unit fixing the disc-formed wafer 200 on the lower surface side thereof, a lower supporting unit 120 and an upper supporting unit 130 holding various units and so forth of the apparatus, an abrasive nozzle 140 supplying an abrasive "A" to the circumferential edge side of the wafer 200, and a polishing pad 150 as the polishing unit polishing the circumferential edge side of the wafer 200. The lower supporting unit 120 and the upper supporting unit 130 are formed so as to cover the wafer 200 from the lower side and the upper side, and have gas blowing ports 160, 170 opened respectively to the surfaces thereof opposing with the wafer 200.

The polishing apparatus 100 is used for removing, by polishing, unnecessary oxide films, metal films and so forth formed on the circumferential edge 210 of the wafer in semiconductor manufacturing processes. FIG. 2 is a cross section drawing of the semiconductor wafer. More specifically, the wafer 200 to be polished in this embodiment is the wafer after a Cu CMP process, and such as having, as shown in FIG. 2, a plasma oxide film 220 and a Ta film 230 as a barrier metal remained on the circumferential edge thereof. The circumferential edge 210 of the wafer 200 herein is a bevel portion 212 formed into an arc form in the plane view including a notch portion 214 formed at a predetermined position in the circumferential direction as being notched to form a near V-shape in the plane view (FIG.8). The polishing apparatus 100 shown in FIG. 1 removes unnecessary films formed on the notch portion 214, whereas unnecessary films formed on the bevel portion 212 is removed by a polishing apparatus 300 shown in FIG. 5. The wafer 200 is transportable between the polishing apparatuses 100 and 300 by a cluster tool. The polishing apparatus 100 for polishing the notch portion will be described first, putting aside the polishing apparatus 300 for polishing the bevel portion for later explanation.

The lower supporting unit 120 and the upper supporting unit 130 as the gas blowing unit are formed into a near-circular shape in the plane view (see FIG. 3), and have the outer diameter almost same as that of the wafer 200. The lower supporting unit 120 and the upper supporting unit 130 are formed with a vertical symmetry to each other. As shown in FIG. 4, the upper supporting unit 130 has a gas passageway 132 formed inside thereof, through which a gas G supplied from the upper portion is guided to the gas blowing port 170. The gas G blown out from the gas blowing ports 160 and 170 then forms the curtain C as shown in FIG. 1. The curtain C separates the space over the wafer 200 between a polishing field PF in which the wafer 200 is polished by the polishing pad 150 and a normal field NF except the polishing field PF. In view of stabilizing flow of the gas G, it is preferable to provide in a chamber a gas discharging mechanism sucking the gas G from the side of the wafer 200 to as much as a volume of the gas G flown into the wafer 200 side.

The lower supporting unit 120 and the upper supporting unit 130 as the blowing unit blows the non-reactive gas G. The non-reactive gas G referred to herein means noble gases, and other gases which do not react with any substances residing in the chamber of the polishing apparatus 100, such as the wafer 200 and the abrasive "A". More specifically, the gas G is preferably helium, argon, nitrogen, dry air and so forth.

As shown in FIG. 3, the gas blowing port 170 of the upper supporting unit 130 is near V-shape in the bottom view, widened outwardly to the circumference. The notch portion 214 of the wafer 200 is near V-shape in the plane view (FIG. 8), so that the gas G, emitted as shown in FIG. 1, is blown against a position inside the notch portion 214 (FIG. 8) in the radial direction. This made the notch portion 214 (FIG. 8) side of the wafer 200 defined as the polishing field PF and the other portion defined as the normal field NF (FIG. 4).

The polishing pad 150 has a disk form with a horizontally-laid rotation axis, and is inserted in the notch portion 214 (FIG. 8) from the outside in the radial direction of the wafer 200 as shown in FIG. 1. The surface of the notch portion 214 (FIG. 8) is then polished by the circumference of the polishing pad 150.

In thus-configured polishing apparatus 100 polishing the semiconductor wafer 200, migration of substances between the polishing field PF and the normal field NF can be suppressed by forming the curtain C of the emitted gas G. By thus forming the curtain C when the circumferential edge 210 side of the wafer 200 is polished using the polishing pad 150, the abrasive "A" supplied to the polishing pad 150 during the polishing and the dusts generated during the polishing can successfully be prevented from migrating into the normal field NF. Because the gas G is blown so as to form the curtain C, the flow of the gas G is relatively stabilized, without being destabilized in the gas flow such as in the conventional apparatus based on the single point blowing of the gas G.

Therefore, the abrasive "A" and the dusts can thoroughly be prevented from adhering onto the circuit-forming region of the wafer 200, the yield ratio of semiconductor devices can be improved, and thereby the operation rates of the individual manufacturing apparatuses in the succeeding stage can be improved.

The first embodiment has shown an exemplary case where the notch portion 214 of the wafer 200 shown in the first embodiment was V-shaped, and the blowing ports 160, 170 were correspondingly V-shaped, whereas the gas blowing ports 160, 170 may be straight-shaped, for example, if the notch portion 214 is notch in a straight form. In short, it will be all right if the curtain C of the gas G is formed so as to isolate the notch portion 214 from the other portion.

As shown in FIG. 5, the polishing apparatus 300 polishing the bevel portion has, as being provided in a chamber thereof, a plurality of rollers 310 as a wafer holding unit holding the circumferential edge of the wafer 200 as being rotatable, a lower supporting unit 320 and an upper supporting unit 330 holding various units and so forth of the apparatus, an abrasive nozzle 340 supplying the abrasive "A" to the circumferential edge side of the wafer 200, and a polishing pad 350 as the polishing unit polishing the circumferential edge side of the wafer 200. The lower supporting unit 320 and the upper supporting unit 330 are formed so as to cover the wafer 200 from the lower side and the upper side, respectively, and have gas blowing ports 360, 370 opened respectively to the surfaces thereof opposing with the wafer 200.

Also this polishing apparatus 300 is used for removing, by polishing, unnecessary oxide films, metal films and so forth formed on the circumferential edge 210 of the wafer 200 during semiconductor processes. The wafer 200 to be a object polished by the polishing apparatus 300 is the wafer 200 which that the notch portion 214 thereof has been polished off by the polishing apparatus 100 polishing the notch portion.

The lower supporting unit 320 and the upper supporting unit 330 as the gas blowing unit are formed into a near-circular shape in the plane view (see FIG. 6), and have the outer diameter almost same as that of the wafer 200. The lower supporting unit 320 and the upper supporting unit 330 are formed with a vertical symmetry to each other. As shown in FIG. 7, the upper supporting unit 330 has a gas passageway 332 formed inside thereof, through which the gas G supplied from the upper portion is guided to the gas blowing port 370.

The gas blowing port 370 is formed into a ring shape in the plane view as shown in the schematic bottom view of the upper supporting unit 330 in FIG. 6, and the gas passageway 332 is formed so as to extend from the center outwardly in the radial direction, and is configured so that the emitted gas G as shown with FIG. 5 is blown against a position inside the bevel portion 212 in the radial direction. The inner portion in the radial direction of the wafer 200 is therefore surrounded as a whole by the ring-shaped curtain C extending in the circumferential direction. More specifically, the ring-shaped curtain C is formed approximately 3 to 5 mm away from the circumferential edge of the wafer 200. That made the bevel portion 212 side defined as the polishing field PF and the other portion defined as the normal field NF (FIG. 7).

The polishing pad 350 has a disk form with a rotation axis inclined from the perpendicular direction, and is configured, as shown in FIG. 5, so that one surface of the polishing pad 350 is brought into contact with the bevel portion 212 curved in the side view. The bevel portion 212 can continuously be polished over the entire circumference, by carrying out the polishing while keeping the wafer 200 being rotated by the rollers 310.

Also in thus-configured polishing apparatus 300 polishing the semiconductor wafer 200, migration of substances between the polishing field PF and the normal field NF can be suppressed by forming the curtain C of the emitted gas G. By thus forming the curtain C when the circumferential edge 210 side of the wafer 200 is polished by using the polishing pad 350, the abrasive "A" supplied to the polishing pad 350 during the polishing and the dusts generated during the polishing can successfully be prevented from infiltrating into the normal field NF. Because the gas G is blown so as to form the curtain C, the flow of the gas G is relatively stabilized, without being destabilized in the gas flow such as in the conventional apparatus blowing the gas on the single point blowing of the gas G.

Therefore, the abrasive "A" and the dusts can thoroughly be prevented from adhering onto the circuit-forming region of the wafer 200, the chip yield on the wafer can be improved, and thereby the operation rates of the individual manufacturing apparatuses in the succeeding stage can be improved.

Figure 9:
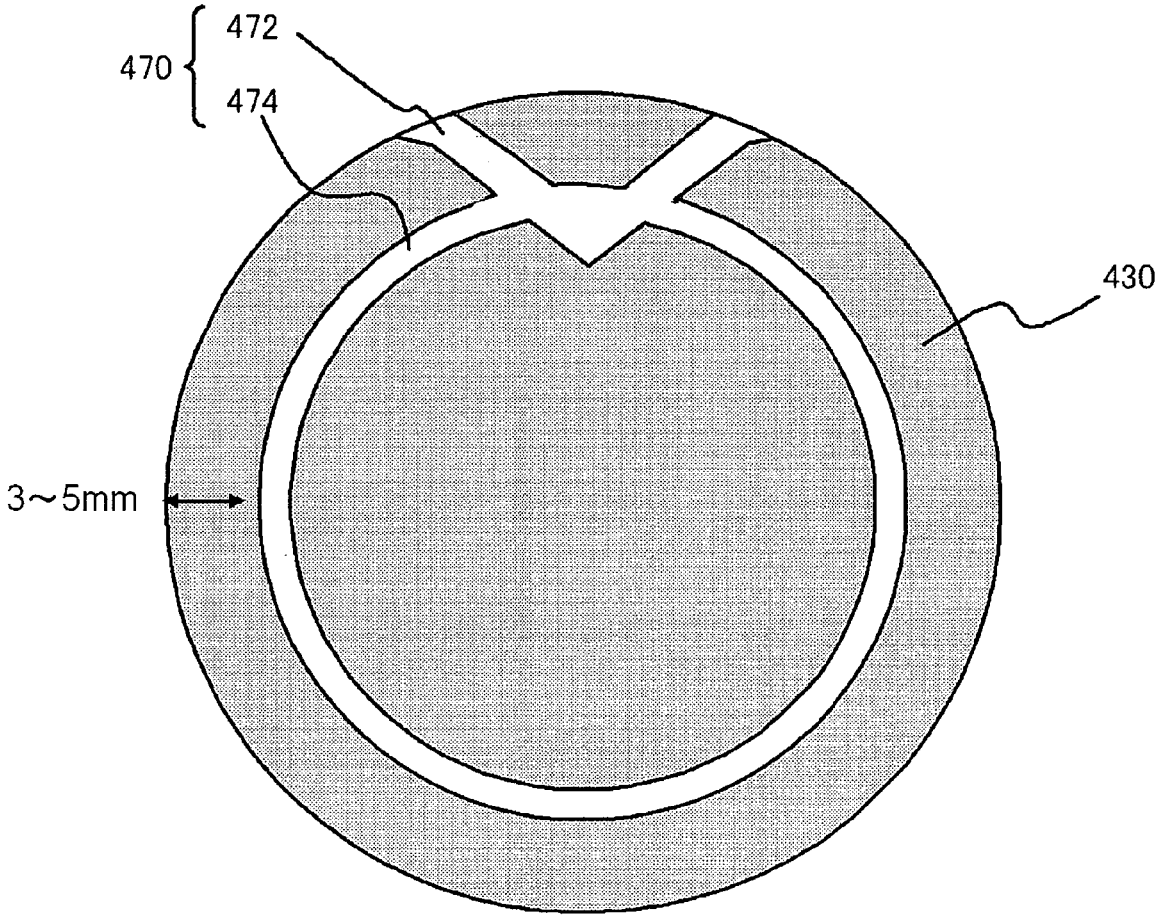
FIG. 9 shows a bottom view of the upper supporting unit of a semiconductor wafer polishing apparatus according to a second embodiment of the present invention.

FIG. 9 is a bottom view of an upper supporting unit of a semiconductor wafer polishing apparatus according to a second embodiment of the present invention.

The polishing apparatus according to the second embodiment can carry out polishing of both of bevel portion 212 and the notch portion 214 in the same chamber, without transferring the wafer 200 in a cluster-tool. In the polishing apparatus, as shown in FIG. 9, a gas blowing port 470 of an upper supporting unit 430 includes a notch-corresponded portion 472 formed in a near V-shape widened outwardly to the circumferential direction in the bottom view, and a bevel-corresponded portion 474 formed into a ring shape in the bottom view. The unillustrated lower supporting unit is formed with a vertical symmetry with the upper supporting unit 430.

The wafer 200 is supported in a rotatable manner, wherein the notch portion 214 is polished using the polishing pad 150 while keeping the wafer 200 standing still, and the bevel portion 212 is polished using the polishing pad 350 while relatively rotating the wafer 200 and the polishing pad 350. The individual polishing pads 150 and 350 are configured so as to movable between a polishing position where the wafer 200 is polished and a stand-by position recessed from the wafer 200.

In either of the cases where the bevel portion 212 and the notch portion 214 are polished, the gas G is blown from the gas blowing port 470 to thereby simultaneously form the V-shaped and the ring-shaped curtains C. More specifically, the inner portion in the radial direction of the wafer 200 is surrounded by the ring-shaped curtain C extending in the circumferential direction, and is isolated from the notch portion 214 by the V-shaped curtain C. By virtue of this configuration, the abrasive "A" supplied to the polishing pads 150 and 350 during the polishing and the dusts generated during the polishing can successfully be prevented from infiltrating into the normal field NF in both polishing processes. By carrying out the polishing processes for the bevel portion 212 and the notch portion 214 in a single polishing apparatus as described in the above, the number of process steps of fabricating semiconductor devices can be reduced, and thereby the production cost can be reduced.

Figure 10:
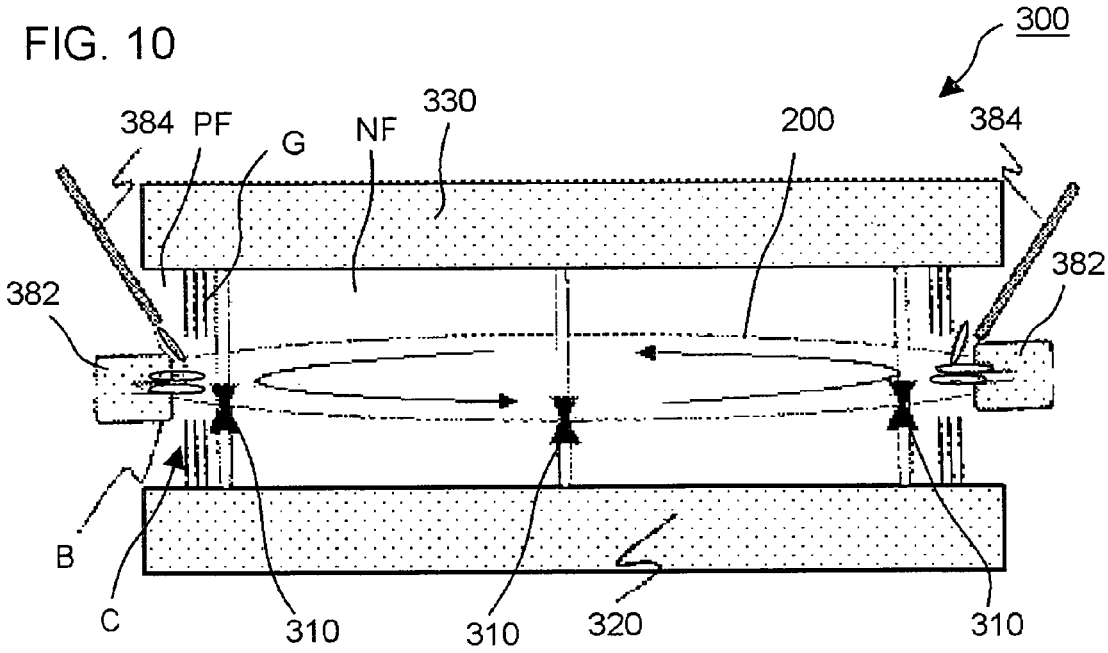
FIG. 10 shows a schematic drawing of a semiconductor wafer polishing apparatus polishing the bevel portion according to a modified example.
Figure 11:
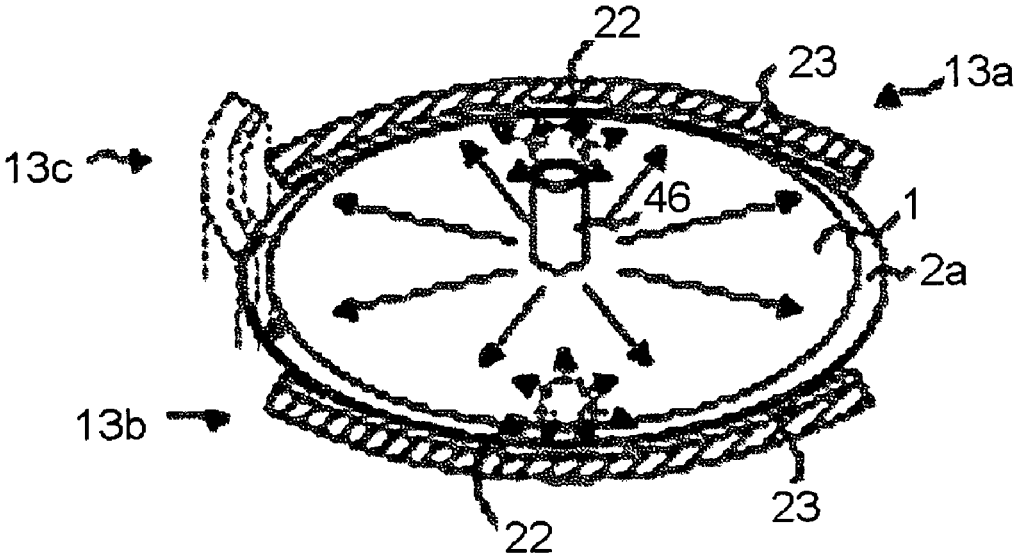
FIG. 11 shows a schematic drawing of a semiconductor wafer polishing apparatus according to a conventional example.

It is to be understood now that, in each of the above-described embodiments, the ring-shaped curtain C of the gas G may be formed also when the circumferential edge 210 is cleaned after the wafer 200 was polished. For an exemplary case, as shown in FIG. 10, where the polishing apparatus 300 polishing the bevel portion is configured as having a cleaning brush 382 cleaning the circumferential edge 210 and a cleaning nozzle 384 supplying a cleaning solution B, and as cleaning the circumferential edge 210 successive to the polishing, the cleaning solution B can be prevented from infiltrating into the inner portion in the radial direction by forming the ring-shaped curtain C during the cleaning.

The polishing apparatus 300 polishing the bevel portion shown in the first embodiment was such as rotating the wafer 200, whereas, for example, the apparatus may be such as moving the polishing pad 350, but is formed herein with a ring shape surrounding the wafer 200 in the plane view, relative to the wafer 200. In other words, the circumferential edge 210 of the wafer 200 can be continuously polished using the polishing pad 350, only if the wafer 200 and the polishing pad 350 relatively rotate.

The way of separating the space over the wafer 200 by using the curtain C may arbitrarily be altered depending on the polishing field on the wafer 200, and any other specific and detailed configurations may, of course, appropriately be modified.

It is apparent that the present invention is not limited to the above embodiment, and may be modified and changed without departing from the scope and spirit of the invention.

What is claimed is:

1. A semiconductor wafer polishing apparatus, comprising:

a polishing unit for polishing a circumferential edge region of a disc-formed wafer; and a gas blowing unit for blowing a gas against a surface of said wafer, so as to separate a space over said wafer by a curtain of said gas extending continuously between said edge region in which said wafer is polished by said polishing unit, and a circuit forming region of said wafer.

2. The semiconductor wafer polishing apparatus as claimed in claim 1, wherein said gas blowing unit blows a non-reactive gas as said gas.

3. The semiconductor wafer polishing apparatus as claimed in claim 1, wherein said polishing unit is structured and arranged to continuously polish said circumferential edge region of said wafer in a circumferential direction, and said gas blowing unit comprises a ring-shaped gas blowing port for blowing said gas so as to form said curtain into a ring shape, viewed in the plane view of said surface, to thereby separate space over said wafer in a radial direction.

4. The semiconductor wafer polishing apparatus as claimed in claim 1, wherein said polishing unit polishes a notch portion formed at a predetermined position in a circumferential direction on the circumferential edge region of said disc-formed wafer.

5. The semiconductor wafer polishing apparatus as claimed in claim 1, further comprising a cleaning unit for cleaning said edge region of said disc-formed wafer.

6. A method of polishing a semiconductor wafer, comprising the steps of:

polishing a circumferential edge region of a disc-formed wafer, and blowing a gas against a surface of said wafer, so as to separate space over said wafer by a curtain of said gas extending continuously between said edge region, in which said wafer is polished by said polishing unit, and a circuit-forming region of said wafer.

7. The method of polishing a semiconductor wafer as claimed in claim 6, wherein said gas is a non-reactive gas.

8. The method of polishing a semiconductor wafer as claimed in claim 6, wherein said polishing step comprises continuously polishing the circumferential edge region in a circumferential direction, and further wherein said blowing step comprises blowing said curtain of said gas in a ring shape, viewed in the plane view of said surface, thereby separating space over said wafer by said curtain in a radial direction.

9. The method of polishing a semiconductor wafer as claimed in claim 6, wherein said polishing step comprises polishing a notch portion formed at a predetermined position in a circumferential direction on the circumferential edge region of said wafer.

10. The method of polishing a semiconductor wafer as claimed in claim 6, wherein, said blowing step blows the gas perpendicularly against the surface of said wafer continuously along an operational boundary between said edge region and said circuit-forming region of said wafer, thereby forming the curtain of said gas between said edge region and said circuit-forming region.

11. A semiconductor wafer polishing apparatus, comprising:

a polishing unit for polishing a circumferential edge region of a disc-formed wafer; and a gas blowing unit for blowing a gas against a surface of said wafer, the gas blowing unit having a gas blowing port structured and arranged to direct said gas perpendicularly against said surface so that the gas blows directly against the wafer, and so that the gas blows as a curtain extending continuously along an operational boundary between said edge region in which the wafer is polished and a circuit-forming region of said surface to be protected from polishing debris, with a space formed over said wafer by the curtain of said gas extending continuously between said edge region, in which said wafer is polished by said polishing unit, and said circuit-forming region.

* * * * *